US009644414B1

(12) United States Patent
Earp, Jr.

(10) Patent No.: US 9,644,414 B1
(45) Date of Patent: May 9, 2017

(54) NO SLAM DOOR GUARD AND METHOD OF USE THEREOF

(71) Applicant: Fred Hutchison Earp, Jr., Selma, NC (US)

(72) Inventor: Fred Hutchison Earp, Jr., Selma, NC (US)

( * ) Notice: Subject to any disclaimer, the term of this patent is extended or adjusted under 35 U.S.C. 154(b) by 0 days.

(21) Appl. No.: 15/041,806

(22) Filed: Feb. 11, 2016

(51) Int. Cl.
*E05F 5/02* (2006.01)

(52) U.S. Cl.
CPC ..... *E05F 5/02* (2013.01); *Y10T 16/615* (2015.01)

(58) Field of Classification Search
CPC ..... E05F 5/02; E05F 5/04; E05F 2005/043; E05F 2005/046; Y10T 16/61; Y10T 16/615; Y10T 16/628; Y10T 16/6285; E05C 17/047; E05C 17/54; D06F 95/002; D06F 95/004; D06F 95/006; A01K 15/02; B65D 88/1668
USPC ..... 16/82, 83, 86 R, 86 A; 292/339, 343, 292/DIG. 15, DIG. 19; D8/402; 383/24; 119/709; 232/1 B
See application file for complete search history.

(56) References Cited

U.S. PATENT DOCUMENTS 1,117,253 A 11/1914 Sargent et al.
2,078,438 A * 4/1937 Baxter ..... D06F 95/002 248/100
4,694,503 A * 9/1987 Hydorn ..... D06F 95/004 248/100
5,332,288 A * 7/1994 Coates ..... B60N 2/4673 296/153
5,369,840 A 12/1994 Salvador et al.
5,503,476 A * 4/1996 Hamdan ..... D06F 95/002 224/585
5,652,998 A 8/1997 McKenzie
6,062,232 A * 5/2000 Johnson ..... A45D 44/02 132/212
6,398,410 B1 * 6/2002 Guerra ..... D06F 95/006 383/117
7,565,884 B2 * 7/2009 Lamstein ..... A01K 15/024 119/706
D616,293 S 5/2010 Goodman et al.
D625,594 S 10/2010 Park et al.
7,892,064 B2 * 2/2011 Carruth ..... A63H 33/00 190/109
8,060,982 B2 11/2011 Magoz et al.
D684,850 S 6/2013 Williams et al.
8,595,899 B2 12/2013 McRoskey et al.
2008/0113583 A1 * 5/2008 Guzman ..... A63H 3/28 446/297
2008/0307604 A1 * 12/2008 Leung ..... E05F 5/06 16/82
2009/0184141 A1 * 7/2009 Marino ..... D06F 57/12 223/69
2009/0283054 A1 * 11/2009 Reyes ..... A01K 15/02 119/708

(Continued)

*Primary Examiner* — William Miller
(74) *Attorney, Agent, or Firm* — Ward and Smith, P.A.; Ryan K. Simmons

(57) ABSTRACT

A guard for and method of preventing household doors from slamming shut when excessive force is used while closing is disclosed. The guard includes a padded body and an attachment mechanism for hanging the guard from a door knob in a manner that allows the guard to swing freely with respect to the door knob. In some embodiments, the guard can include certain electronics to indicate and/or store "door slam events."

24 Claims, 19 Drawing Sheets

(56) References Cited

U.S. PATENT DOCUMENTS

| | | | | |
|---|---|---|---|---|
| 2011/0280500 | A1* | 11/2011 | Nelson | A45C 3/00<br>383/16 |
| 2014/0084606 | A1* | 3/2014 | Packer | E05C 17/54<br>292/343 |

* cited by examiner

NO SLAM DOOR GUARD AND METHOD OF USE THEREOF

TECHNICAL FIELD

The presently disclosed subject matter relates generally to accessories for doors and more particularly to a no slam door guard ("guard") and method.

BACKGROUND

Each year a large number of people, particularly children, are injured when their hands or fingers are crushed by a closing door. Children are extremely susceptible to injuries of this nature because of their inquisitive nature and diminutive size and strength combine to create many potentially dangerous situations. While many accidents occur which only cause relatively minor pain and bruises, other injuries involving relatively heavy doors can cause broken bones or even permanent disfigurement of the child. Additionally, when excessive force is used to close a door, the door slams shut. The use of excessive force to slam a door shut is not only dangerous, it can also cause damage to the door.

SUMMARY

In an aspect, the presently disclosed subject matter provides a guard for preventing a household door from slamming shut when excessive force is used to close the household door, comprising: a padded body comprising a first end for positioning in proximity to a door knob of a household door and a second end opposite the first end for positioning away from the door knob; and an attachment mechanism integrated into the first end of the padded body for hanging the padded body from the door knob of the household door in a manner that allows the padded body to swing freely with respect to the door knob; wherein when the padded body is hung from the door knob of the household door via the attachment mechanism and excessive force is used to close the household door, centrifugal force causes the padded body to swing between the edge of the household door and door jamb to prevent the household door from slamming shut.

In some embodiments, when the padded body is hung on the exterior door knob of the household door the padded body hangs in a resting vertical position. In some embodiments, after preventing the household door from slamming shut, the padded body returns back to the resting vertical position, thereby allowing the door to be closed using a gentle force. In some embodiments, when the household door is closed slowly and/or without excessive force, the padded body remains substantially in the resting vertical position while the door swings closed and does not prevent the household door from closing. In some embodiments, when the centrifugal force causes the padded body to swing from the resting vertical position towards a horizontal position where the second end of the padded body swings outward beyond the boundary of a latch edge of the household door.

In some embodiments, the padded body comprises a body formed of a pad-like material. In some embodiments, the pad-like material comprises a molded polymer. In some embodiments, the body is formed into a shape. In some embodiments, the body has a minimum thickness dimension of ¼ inch, a minimum width dimension of 1 inch, and a minimum length dimension of 7 inches. In some embodiments, the body has a maximum thickness dimension of 6 inches, a maximum width dimension of 3.75 inches, and a maximum length dimension of 14 inches. In some embodiments, the padded body comprises a body for holding a pad. In some embodiments, the pad is formed into a shape. In some embodiments, the shape is selected from the group consisting of a cartoon image, a collegiate mascot, an insignia, a word, a letter, an emblem, a cylinder, a heart, a happy face, a semi-circle, a rectangle, a circle, a trapezoid, and combinations thereof. In some embodiments, the pad has a minimum thickness dimension of ¼ inch, a minimum width dimension of 1 inch, and a minimum length dimension of 7 inches. In some embodiments, the pad has a maximum thickness dimension of 6 inches, a maximum width dimension of 3.75 inches, and a maximum length dimension of 14 inches.

In some embodiments, the body comprises a fabric covering the pad. In some embodiments, the fabric comprises a gathered portion proximal the first end. In some embodiments, the gathered portion is stitched or sewn closed. In some embodiments, the gathered portion extends for less than or equal to an inch from the edge of the first end. In some embodiments, the fabric comprises a pocket. In some embodiments, the fabric comprises a design. In some embodiments, the fabric comprises a phosphorescent image. In some embodiments, the phosphorescent image is produced using a phosphorescent material selected from the group consisting of a phosphorescent dye, a phosphorescent paint, and a phosphorescent powder.

In some embodiments, the attachment mechanism is non-abrasive. In some embodiments, the attachment mechanism is selected from the group consisting of a band, a hook, and a loop, a rope, or cord. In some embodiments, at least a portion of the attachment mechanism is sewn into and/or adhered onto the first end of the padded body. In some embodiments, at least a portion of the attachment mechanism is cast into the first end of the padded body. In some embodiments, at least a portion of the attachment mechanism projects radially outwardly from an edge of the padded body at the first end. In some embodiments, the attachment mechanism allows the padded body to hang freely and centered below a stem of the door knob when the at least the portion of the attachment mechanism is placed around the stem of the door knob. In some embodiments, the attachment mechanism comprises a combination of a grommet and at least one of a band, a rope, or a cord. In some embodiments, the grommet is integrated into the first end of the padded body and at least one of the band, the rope, or the cord is looped through the grommet. In some embodiments, the loop slides through the grommet in such a way as to form a knot that is larger in size than the opening in the grommet. In some embodiments, the attachment mechanism further comprises a security mechanism to prevent a child from easily removing the guard from the door knob. In some embodiments, the security mechanism is selected from the group consisting of a clasp, hasp, and a threaded connection. In some embodiments, the security mechanism comprises a threaded clasp. In some embodiments, the security mechanism is incorporated into the attachment mechanism. In some embodiments, the attachment mechanism comprises a combination of two grommets and at least one of a band, a rope, or a cord that is stretched between the two grommets.

In some embodiments, the guard can be installed on the household door to prevent the household door from slamming shut via the attachment mechanism without marring the household door in any way. In some embodiments, the guard can be installed on the household door to prevent the household door from slamming shut without modifying the structure of the household door in any way other than by attaching the attachment mechanism to the door knob. In some embodiments, the guard can be installed on the household door to prevent the household door from slamming shut using only the attachment mechanism without requiring any additional hardware. In some embodiments, the guard can be installed on the household door to prevent the household door from slamming shut using only the attachment mechanism without using any screws. In some embodiments, the guard can be installed on the household door to prevent the household door from slamming shut using only the attachment mechanism without using an adhesive or a peel and stick mounting. In some embodiments, the guard prevents the household door from slamming shut. In some embodiments, the second end of the padded body lacks a mechanism for attaching the second end of the padded body to a door knob on the opposite side of the household door. In some embodiments, when the attachment mechanism is used to hang the padded body from the door knob of the household door, the second end of the padded body remains on the same side of the household door as the door knob. In some embodiments, the guard further comprises an electronic component integrated into the padded body. In some embodiments, the electronic component is selected from the group consisting of a sensing device, a visual indicator, an audible indicator, a control device, a communications device, and any combination thereof. In some embodiments, the electronic component is selected from the group consisting of a motion sensor, a pressure sensor, a sound module, an LED module, and combinations thereof. In some embodiments, the guard further comprises a power source to supply power the electronics component.

In another aspect, the presently disclosed subject matter provides a method of preventing a household door from slamming shut when excessive force is used to close the household door, comprising: providing a guard for preventing a household door from slamming shut when excessive force is used to close the household door, the guard comprising: a padded body comprising a first end for positioning in proximity to a door knob of a household door and a second end opposite the first end for positioning away from the door knob; and an attachment mechanism integrated into the first end of the padded body for hanging the padded body from the door knob of the household door in a manner that allows the padded body to swing freely with respect to the door knob; and instructing a purchaser of the guard to hang the guard on an exterior door knob of a household door of the purchaser; wherein when the padded body is hung from the door knob of the household door of the purchaser via the attachment mechanism and excessive force is used to close the household door, centrifugal force causes the padded body to swing between the edge of the household door and door jamb to prevent the household door from slamming shut, thereby preventing the household door from slamming shut when excessive force is used to close the household door.

In some embodiments, the method includes the step of providing a visual or audible indication that the door is being slammed shut when excessive force is used to close the door. In some embodiments, the method includes the step of playing a pre-recorded message that provides a warning to stop slamming the door when excessive force is used to close the door. In some embodiments, the method includes the step of providing a security mechanism on the attachment mechanism to prevent a child from easily removing the guard from the door knob.

BRIEF DESCRIPTION OF THE DRAWINGS

Figure 1A:
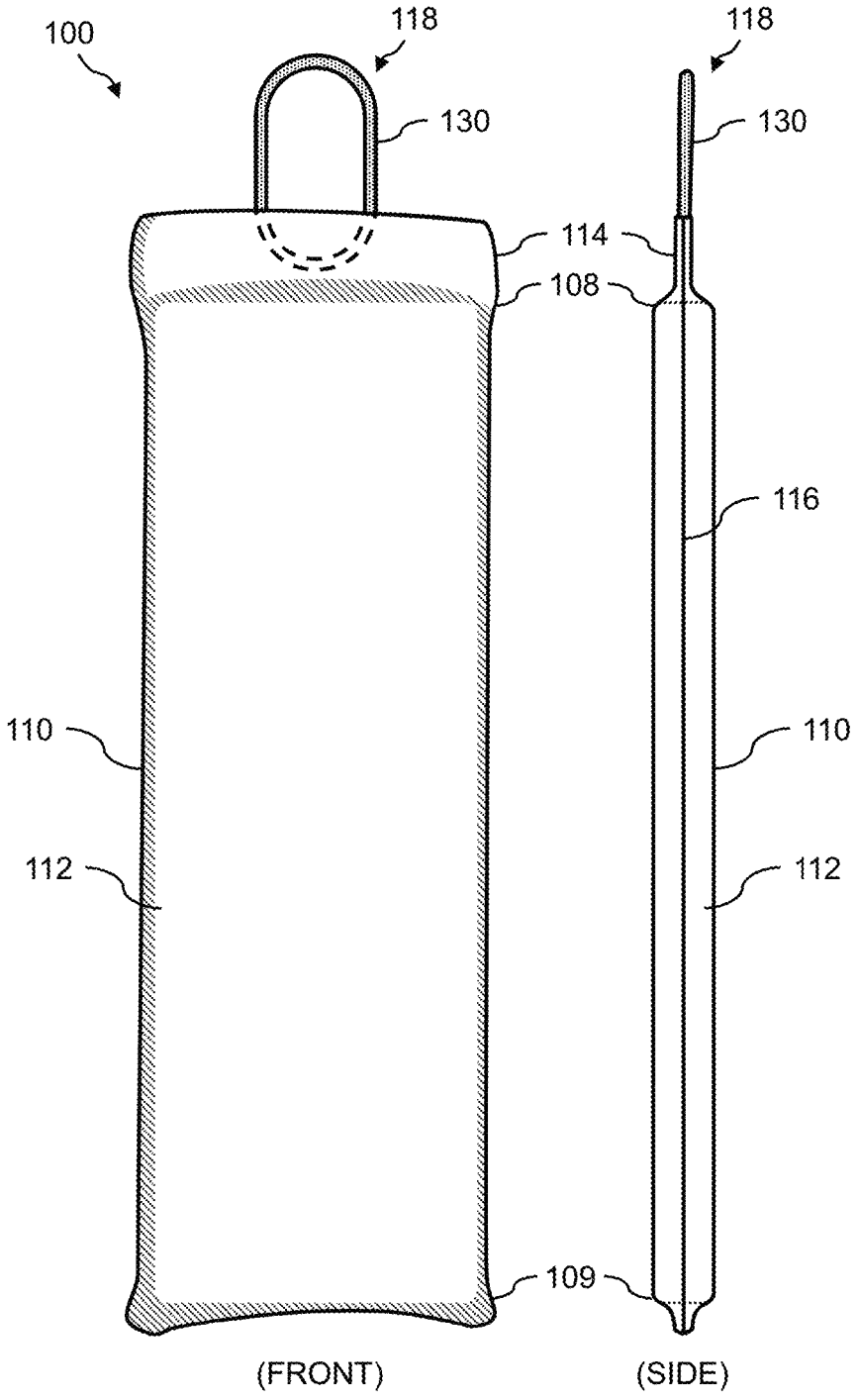
Figure 1B:
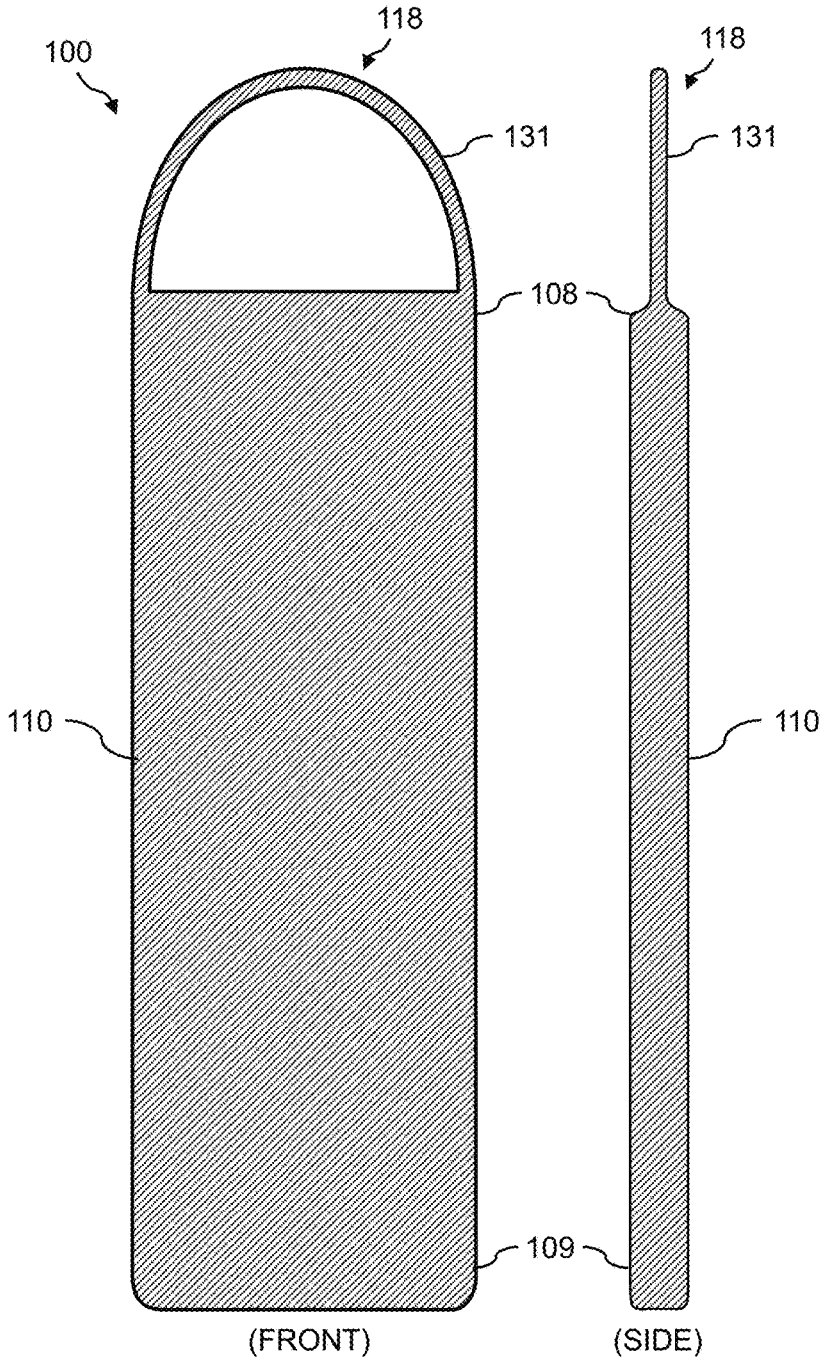

Having thus described the presently disclosed subject matter in general terms, reference will now be made to the accompanying Drawings, which are not necessarily drawn to scale, and wherein:

FIG. 1A illustrates a front view and a side view of an example of the presently disclosed guard, wherein the attachment mechanism is a band sewn into the fabric;

FIG. 1B illustrates a front view and a side view of an example of the presently disclosed guard, wherein the padded body is a molded polymer and the attachment mechanism is a loop cast in the padded body.

Figure 2:
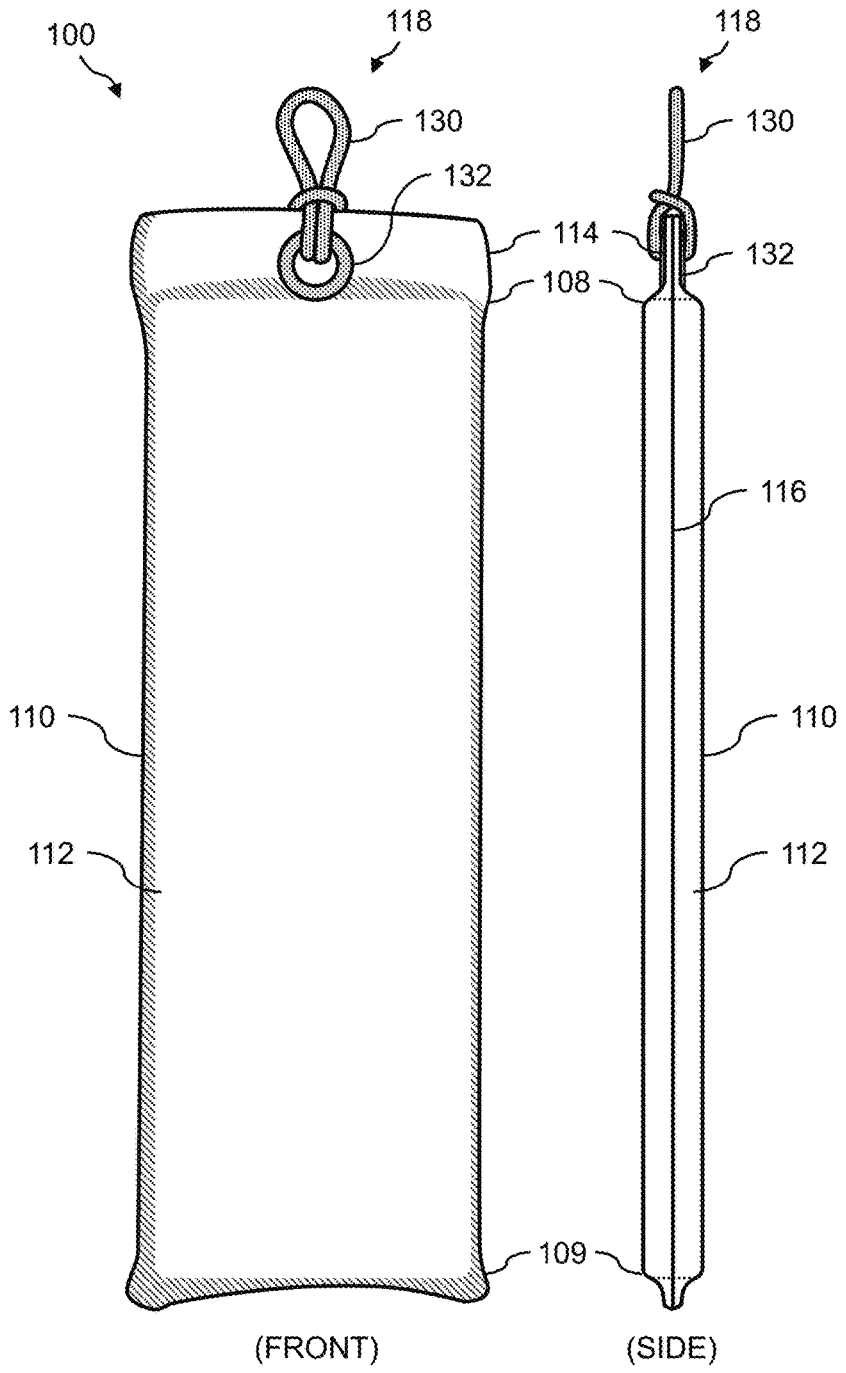
Figure 3:
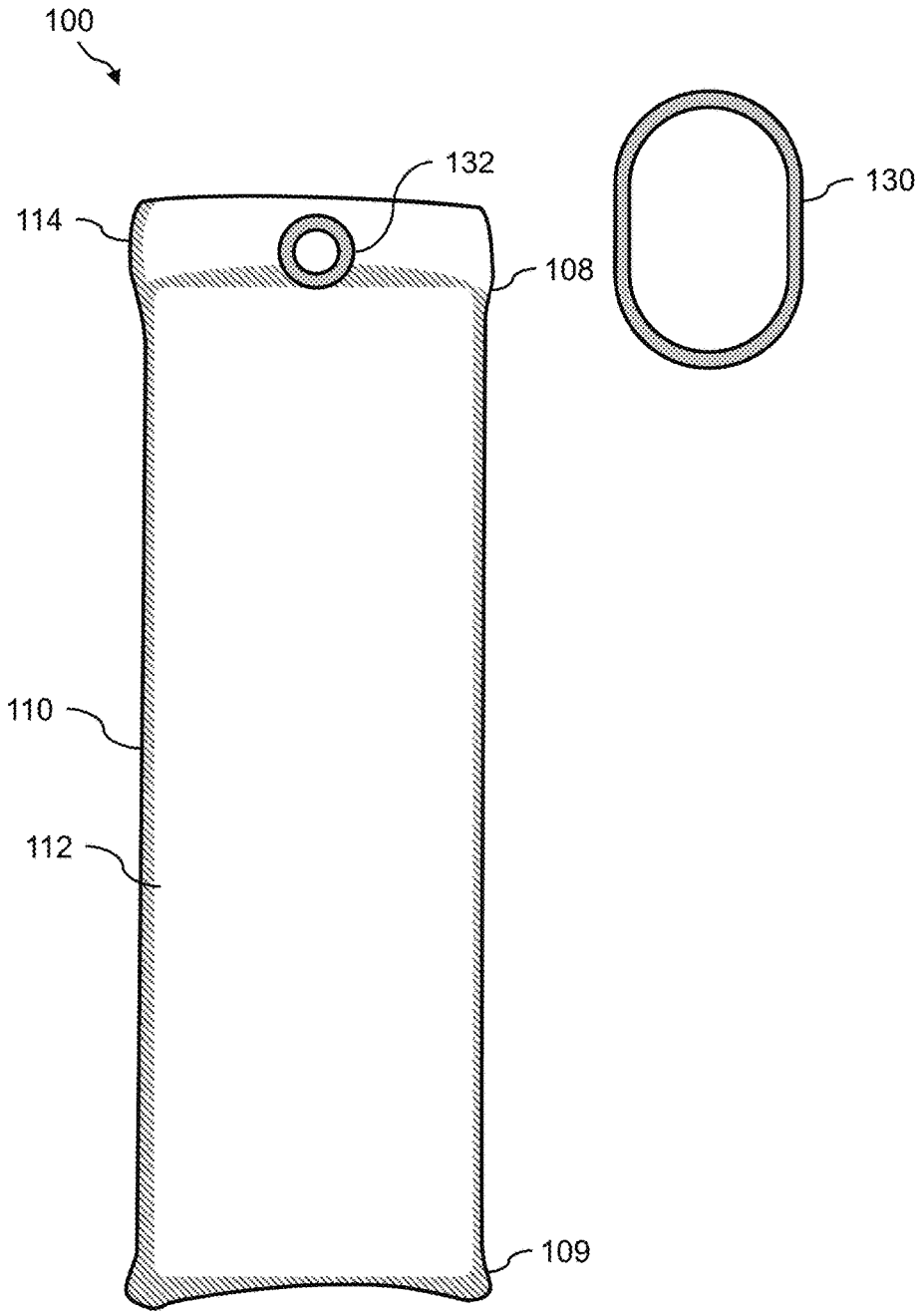
Figure 4:
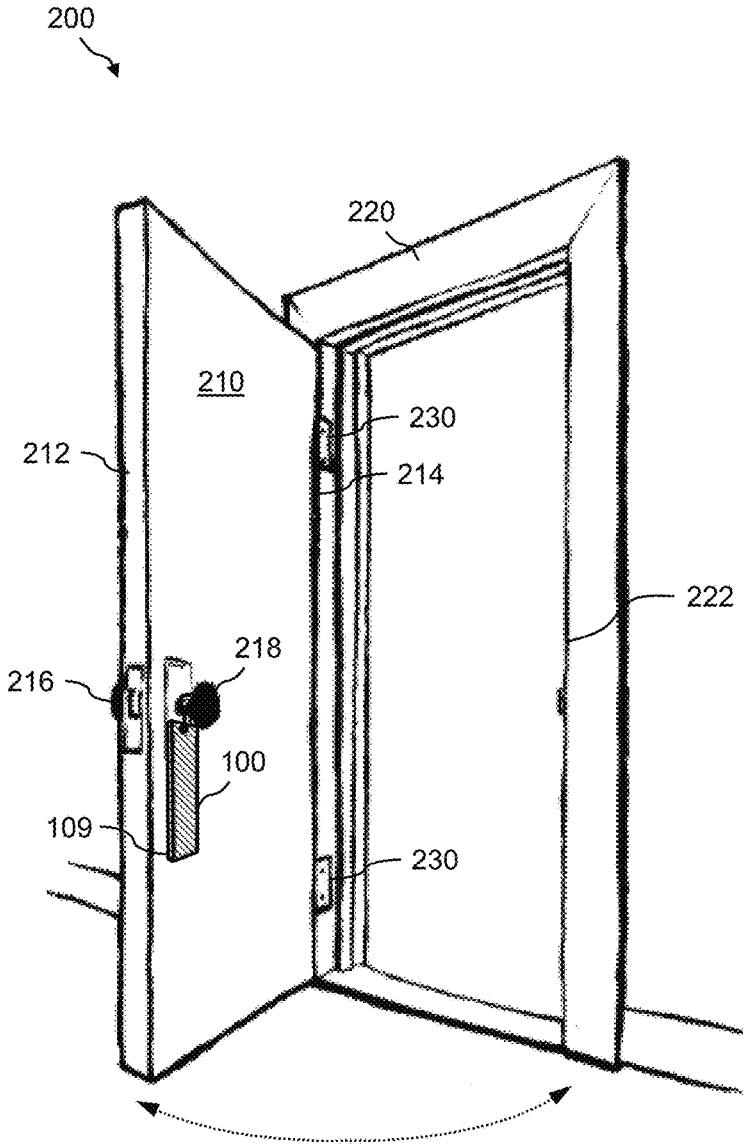
Figure 5:
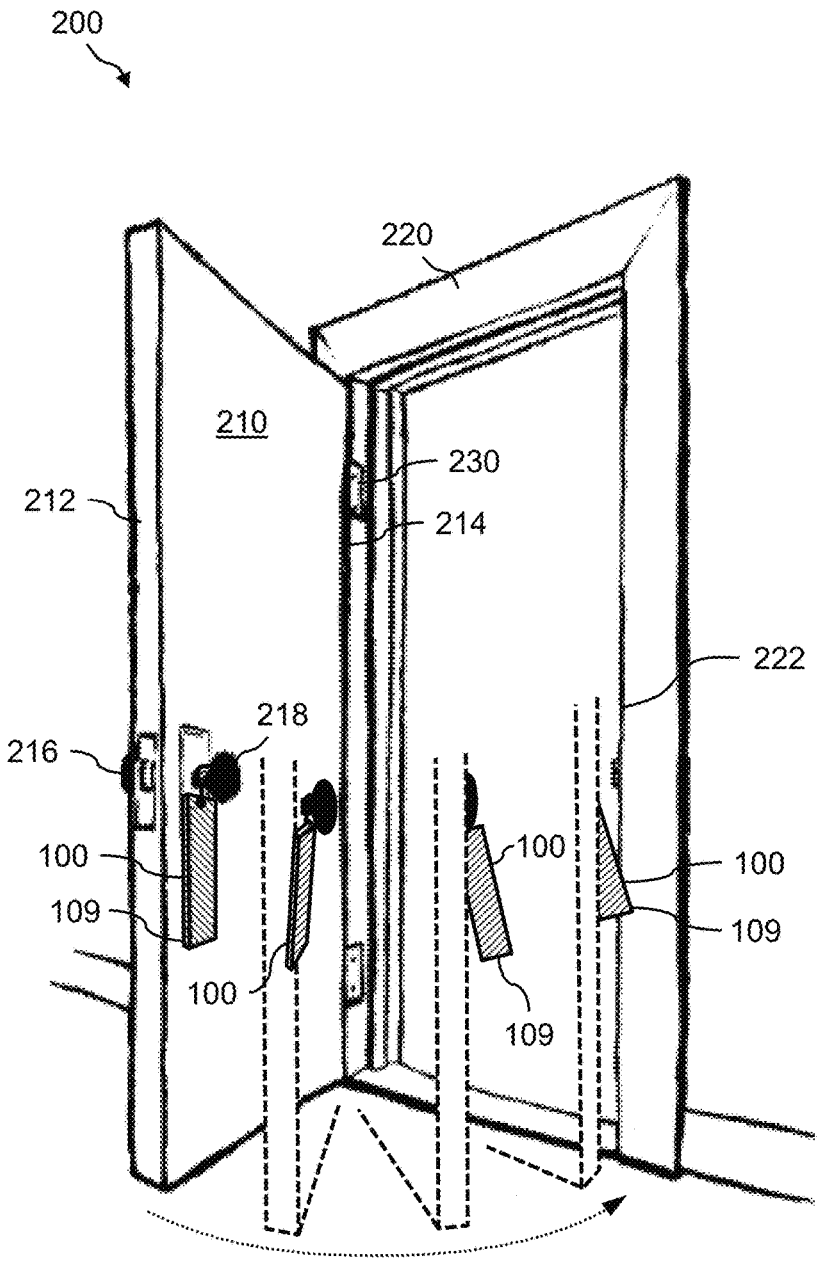
Figure 6:
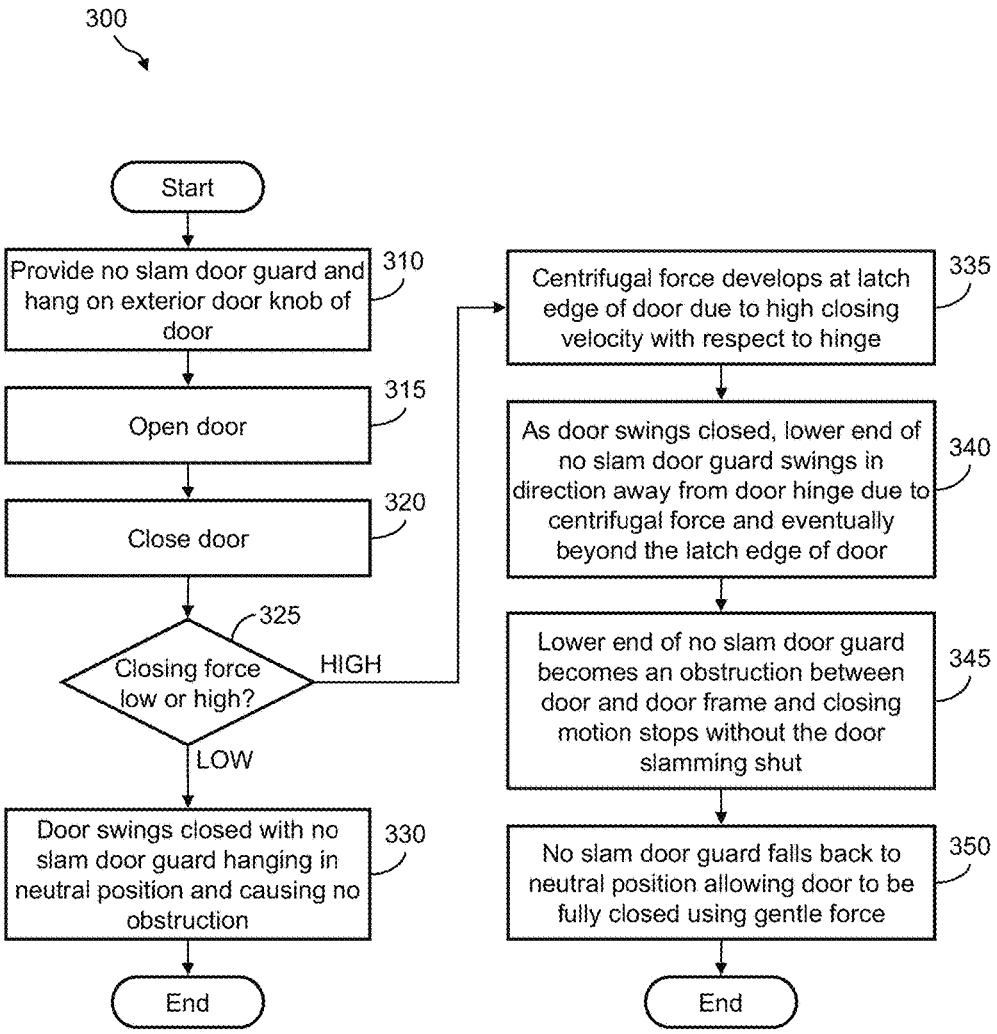
Figure 7:
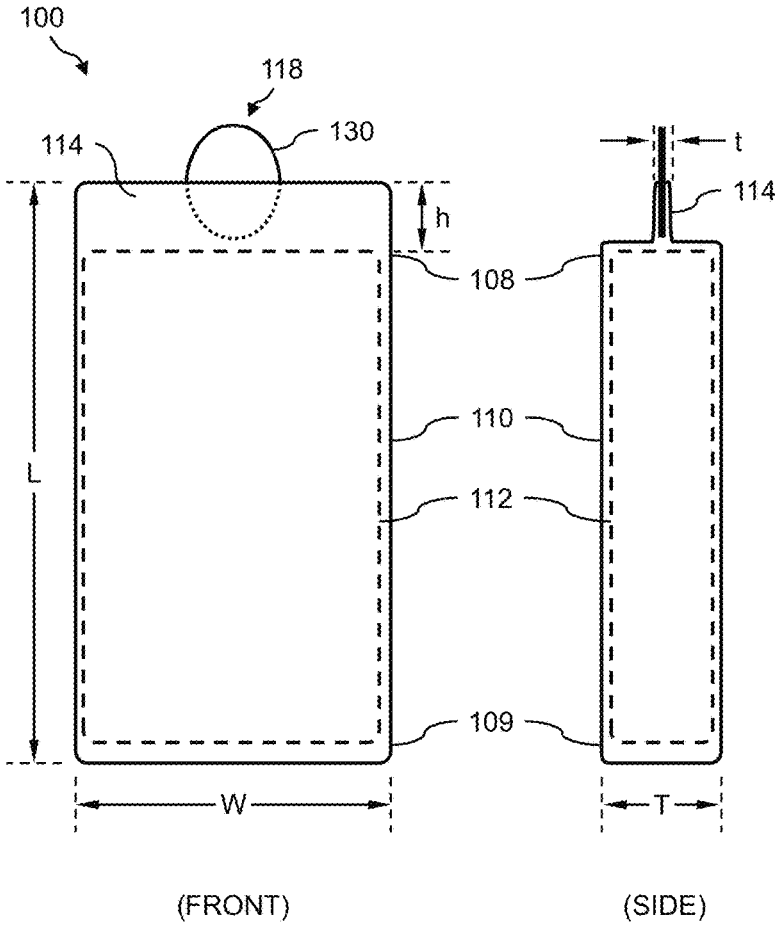
Figure 8:
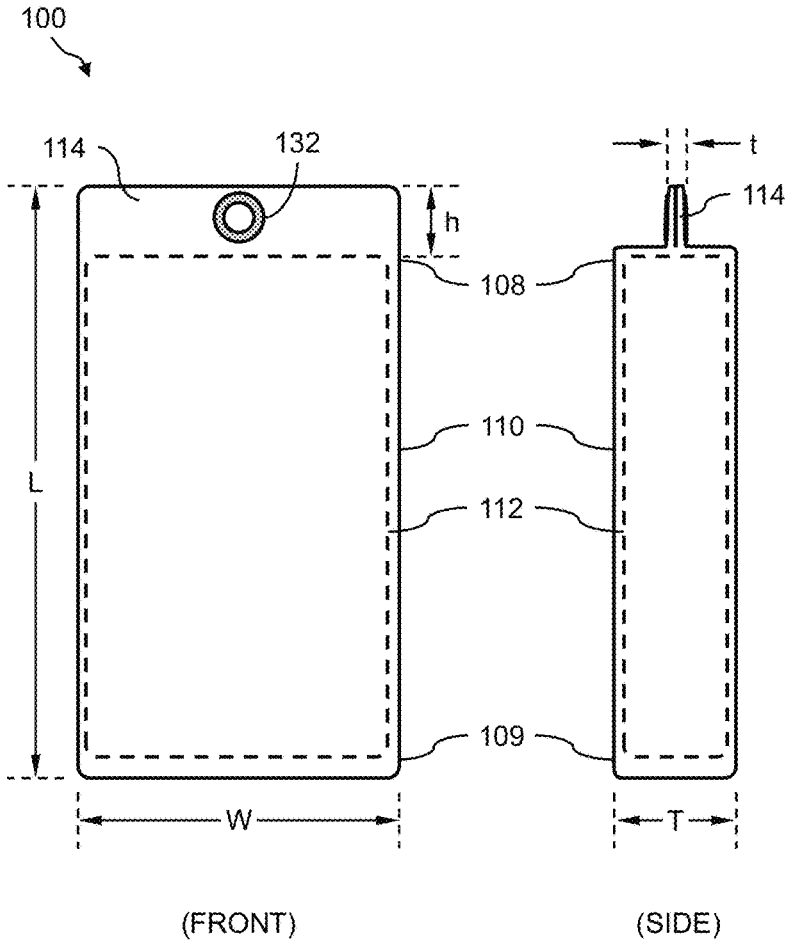
Figure 9:
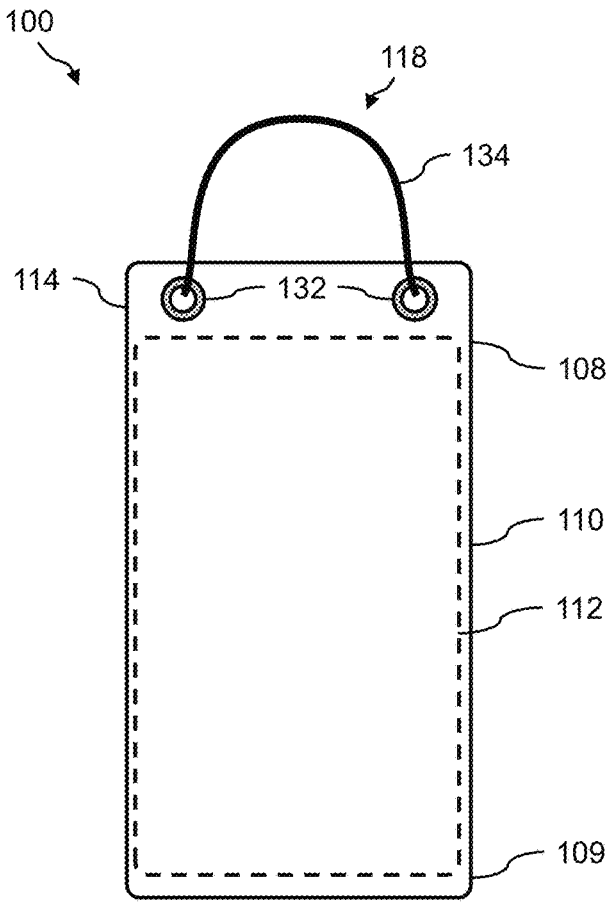
Figure 10:
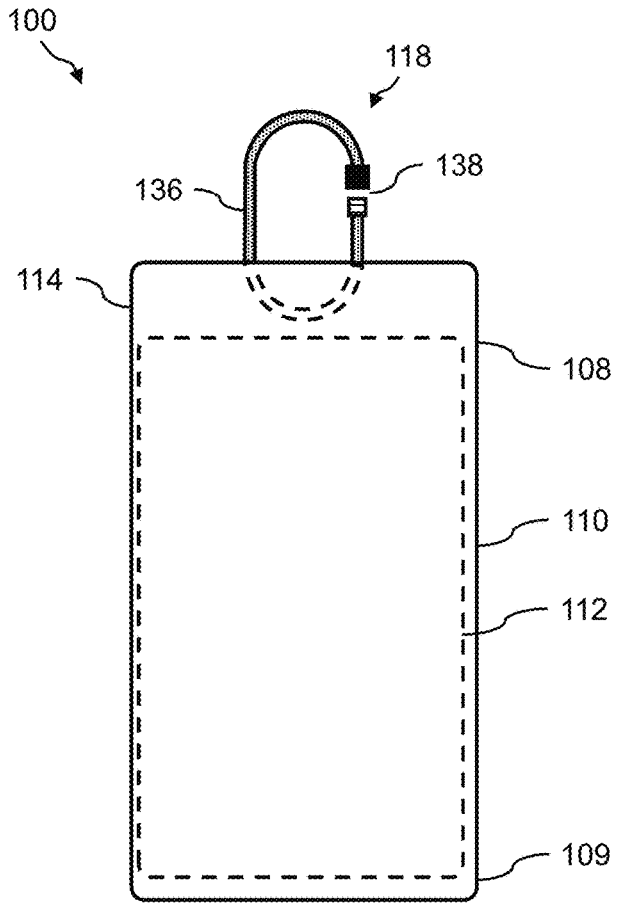
Figure 11:
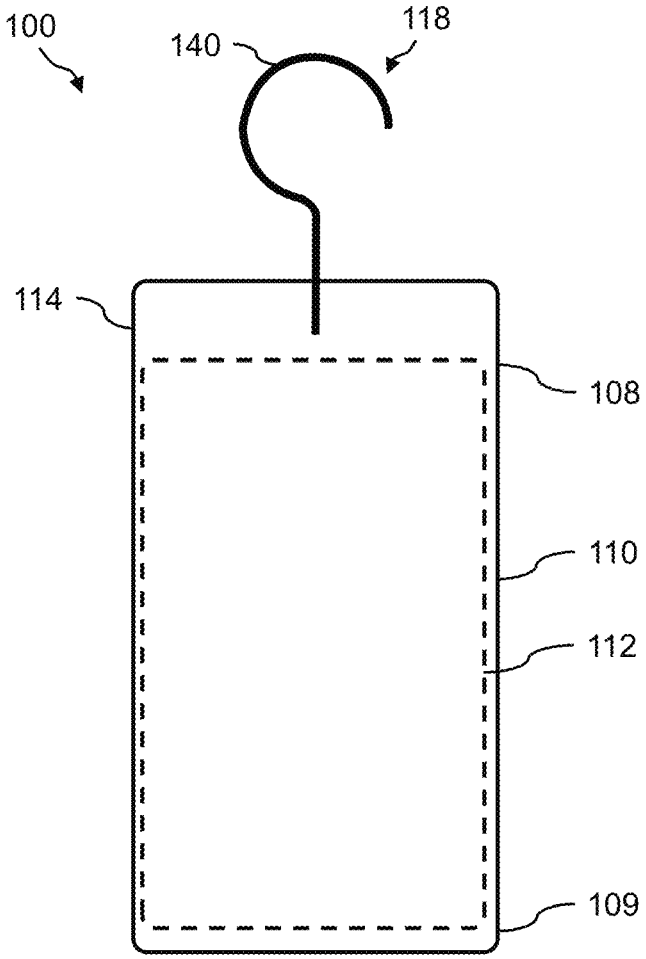
Figure 12:
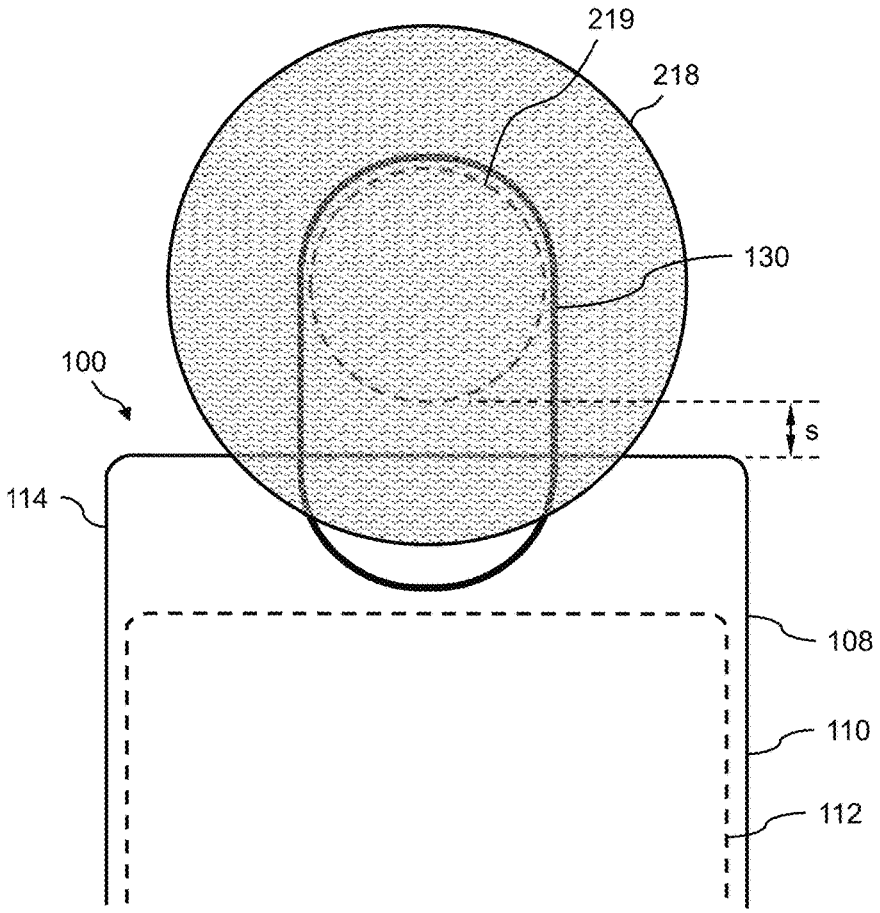
Figure 13:
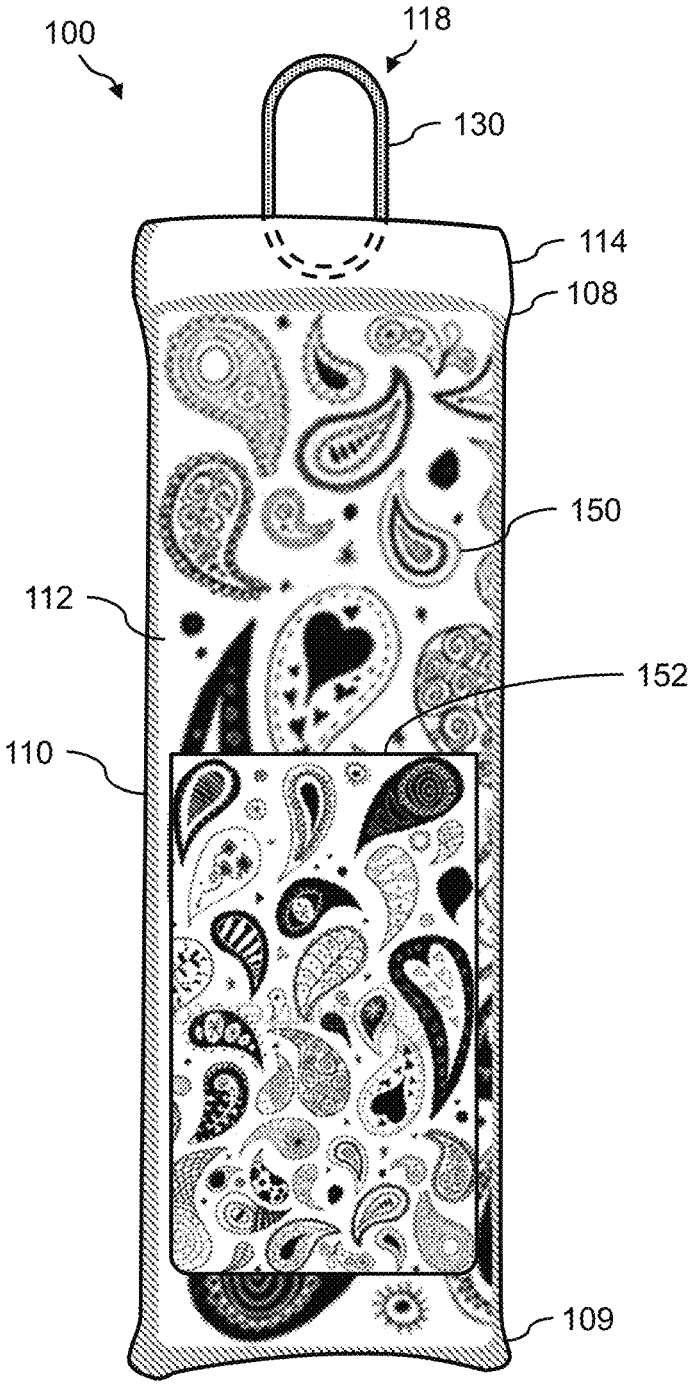
Figure 14A:
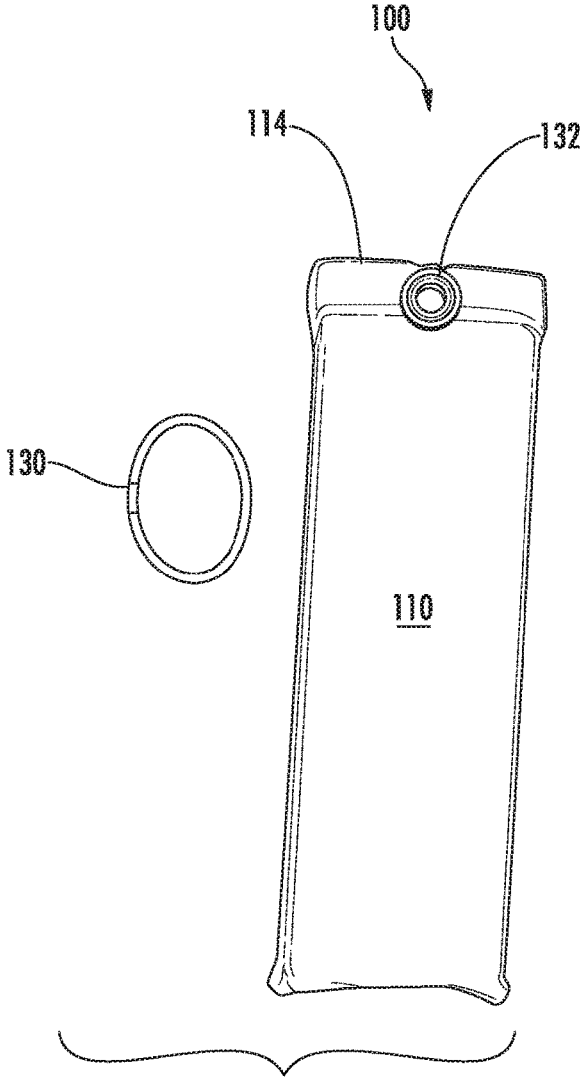
Figure 14B:
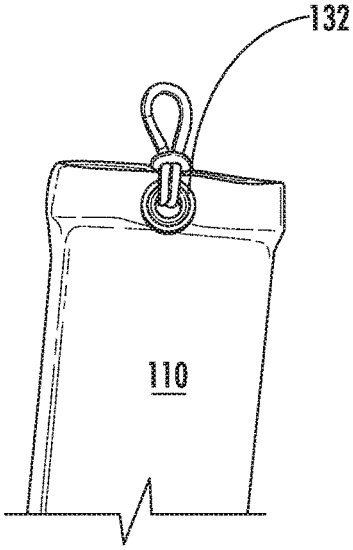
Figure 15:
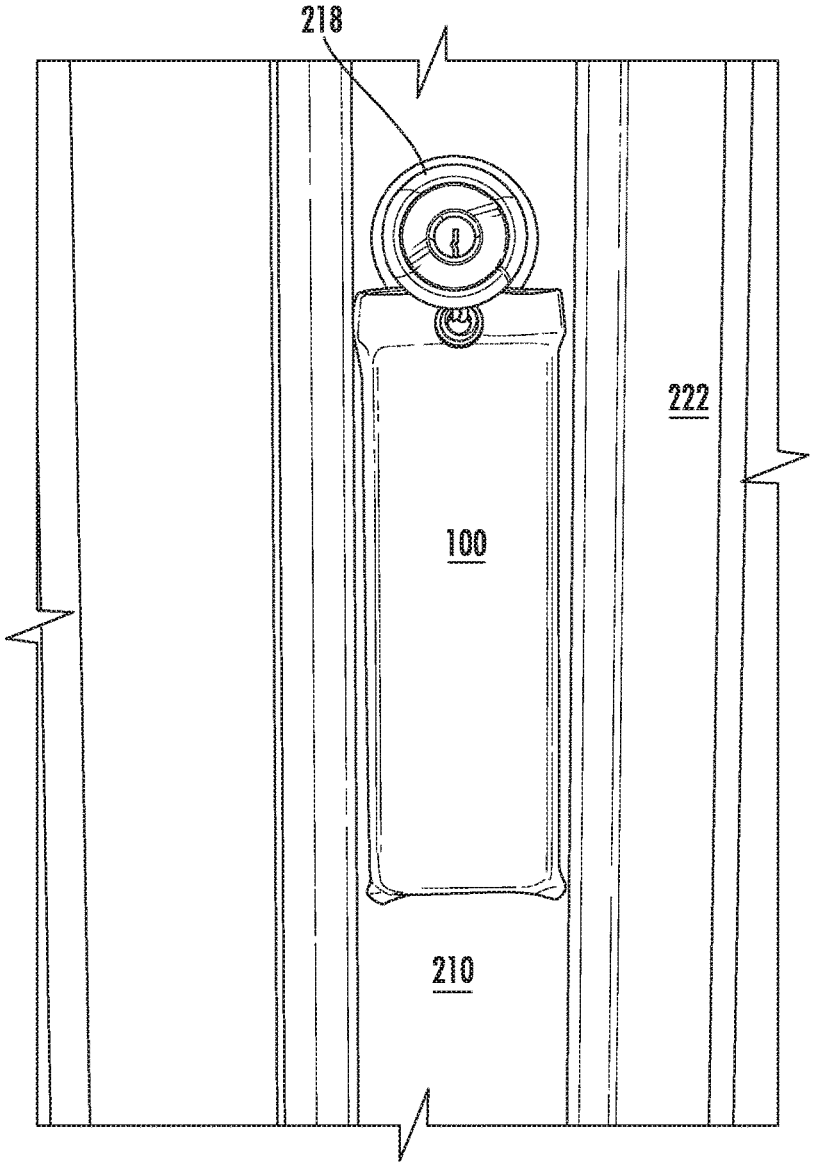
Figure 16:
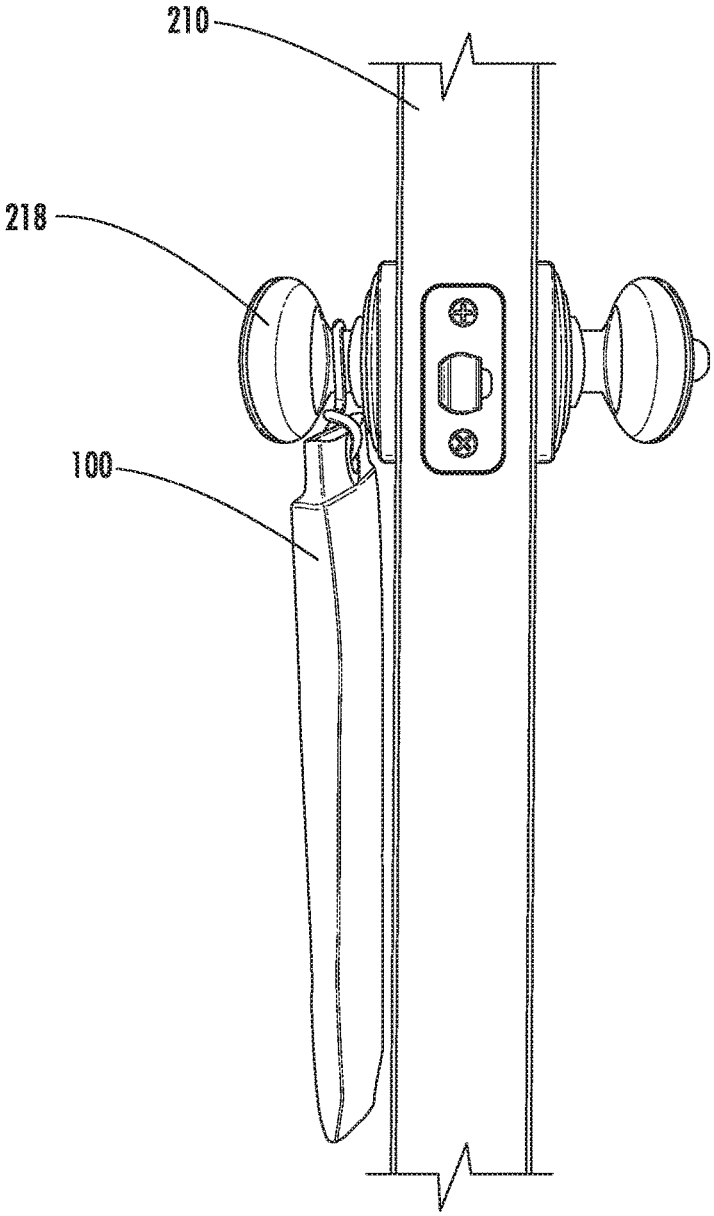
Figure 17:
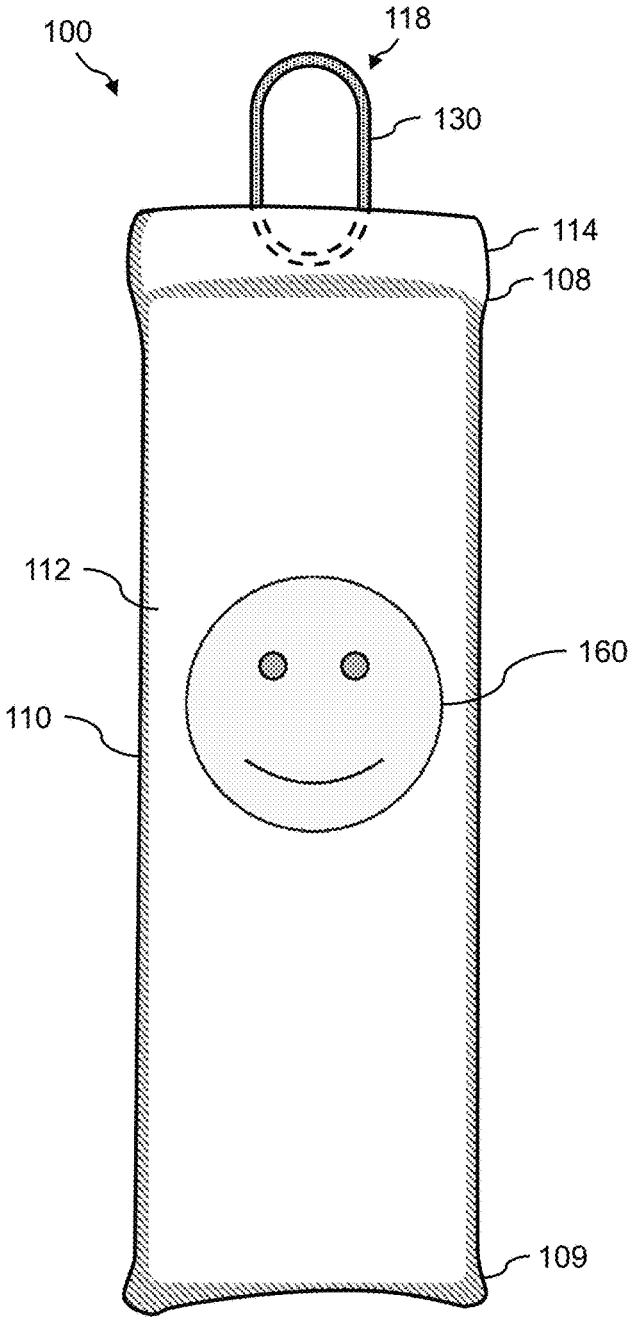
Figure 18:
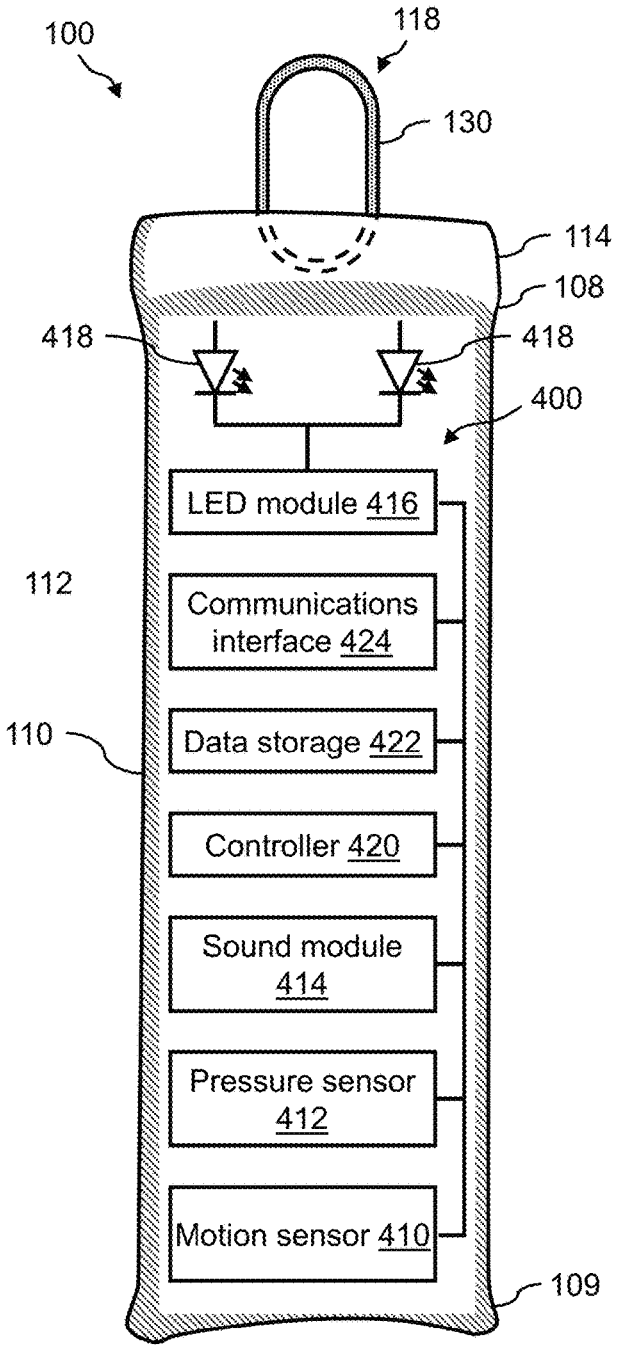

FIG. 2 and FIG. 3 show another example of the presently disclosed guard, wherein the attachment mechanism is a grommet and a band, rope, or cord;

FIG. 4 illustrates a perspective view of the presently disclosed guard installed on the exterior door knob of a door;

FIG. 5 illustrates a perspective view of the operation of the presently disclosed guard;

FIG. 6 illustrates a flow diagram of an example of a method of operation of the presently disclosed guard;

FIG. 7 shows an example of the dimensions of the presently disclosed guard that includes the band sewn into the fabric;

FIG. 8 shows an example of the dimensions of the presently disclosed guard that includes the grommet;

FIG. 9 shows yet another example of the presently disclosed guard, wherein the attachment mechanism is two grommets and a band, rope, or cord;

FIG. 10 shows yet another example of the presently disclosed guard, wherein the attachment mechanism is the band sewn into the fabric and a threaded clasp;

FIG. 11 shows yet another example of the presently disclosed guard, wherein the attachment mechanism is a hook;

FIG. 12 shows more details of the presently disclosed guard in relation to a door knob on which it is hung;

FIG. 13 shows yet another example of the presently disclosed guard, wherein the body has a pattern or design and includes a pocket;

FIG. 14A and FIG. 14B show photos of an example of the presently disclosed guard, wherein the attachment mechanism is the grommet and the band, rope, or cord;

FIG. 15 and FIG. 16 show photos of the guard shown in FIG. 14A and FIG. 14B when hung on a door knob;

FIG. 17 shows yet another example of the presently disclosed guard, wherein the body has a phosphorescent image incorporated thereon; and FIG. 18 shows still another example of the presently disclosed guard 100, wherein one or more electronic devices is embedded in the pad of the guard.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a guard for and method of preventing household doors from slamming shut when excessive force is used while closing. The presently disclosed guard includes a padded body and an attachment mechanism for hanging the guard from a door knob in a manner that allows the padded body of the guard to swing freely with respect to the door knob.

An aspect of the presently disclosed guard and method is that it can be used to prevent doors from slamming shut and thereby avoid potential damage to the door, as well as injury to a child's fingers when they are caught between the door and door jamb of a door that is closed used excessive force.

Accordingly, the presently disclosed subject matter provides a guard for preventing a household door from slamming shut when excessive force is used to close the household door, comprising: a padded body comprising a first end for positioning in proximity to a door knob of a household door and a second end opposite the first end for positioning away from the door knob; and an attachment mechanism integrated into the first end of the padded body for hanging the padded body from the door knob of the household door in a manner that allows the padded body to swing freely with respect to the door knob; wherein when the padded body is hung from the door knob of the household door via the attachment mechanism and excessive force is used to close the household door, centrifugal force causes the padded body to swing between the edge of the household door and door jamb to prevent the household door from slamming shut. When the padded body is hung on the exterior door knob of the household door the padded body hangs in a resting vertical position. When the centrifugal force causes the padded body to swing from the resting vertical position towards a horizontal position where the second end of the padded body swings outward beyond the boundary of a latch edge of the household door, thereby preventing the household door from slamming shut (and avoiding injury to any children's fingers that are between the door and the door jamb). After preventing a household door from slamming shut, the padded body returns back to the resting vertical position, thereby allowing the door to be closed using a gentle force. When the household door is closed slowly and/or without excessive force, the padded body remains substantially in the resting vertical position while the door swings closed and does not prevent the household door from closing.

The guard can be installed on a household door to prevent the household door from slamming shut via the attachment mechanism without marring the household door in any way. The guard can be installed on a household door to prevent the household door from slamming shut without modifying the structure of the household door in any way other than by attaching the attachment mechanism to the door knob. The guard can be installed on a household door to prevent the household door from slamming shut using only the attachment mechanism without requiring any additional hardware. The guard can be installed on a household door to prevent the household door from slamming shut using only the attachment mechanism without using any screws. The guard can be installed on a household door to prevent the household door from slamming shut using only the attachment mechanism without using an adhesive or a peel and stick mounting.

In some embodiments, the guard can be used as a decoration for door knob and door. Further, the guard can include a pocket that can be used to hold small items (e.g., written messages) that are left for inhabitants.

Referring now to FIG. 1A is a front view and a side view of an example of the presently disclosed guard 100, wherein the attachment mechanism of the guard 100 is a band sewn into the fabric. The presently disclosed guard 100 can be used to prevent household doors from slamming shut when excessive force is used while closing.

In some embodiments, the padded body includes a body 110 for holding a pad 112. In one example, the body 110 is a fabric covering over the pad 112. Any suitably durable fabric can be used, such as, but not limited to, nylon, denim, linen, canvas, cotton, neoprene, polyester blends, vinyl, microfiber, leather, and faux leather. In another example, the body 110 is formed of molded polymer. In the case of the fabric body 110, which is shown in FIG. 1A, the pad 112 can be inserted through an opening at one end of the body 110, for example, at the first end 108, then the end is closed (e.g., via stitching or sewing). In some embodiments, the fabric is stitched closed to form a gathered portion 114 proximal the first end 108 of body 110. The gathered portion 114 can provide an area of body 110 at which attachment mechanism 118 can be integrated. In some embodiments, gathered portion 114 extends for less than or equal to an inch from the end of first end 108. Of course, it should be appreciated that pad 112 can be inserted into an opening at the second end 109 and the second end can be stitched closed, optionally to form a gathered portion at second end 109. It should also be appreciated that a gathered portion 114 can be formed at first end 114 regardless of whether pad 112 is inserted into body 110 via first end 108 or second end 109. The presently disclosed subject matter further contemplates embodiments in which pad 112 can be inserted into body 110 via either side of first end 108 or 109. Further, a seam 116 is shown around the periphery of the fabric body 110.

Referring now to FIG. 1B is a front view and a side view of an example of the presently disclosed guard 100, wherein the padded body comprises a body 110 formed of a pad-like material. The pad-like material 111 can be a molded polymer (e.g., formed via injection molding). In such embodiments, the attachment mechanism 118 can be cast into the molded polymer, for example, loop 131 can be cast into the molded polymer to form guard 100 wherein the body 110 and attachment mechanism 118 are an integral unit formed of the same material. The presently disclosed subject matter contemplates the use of any polymeric material (e.g., foams, rubbers, etc.) that are weather resistant, non-corrosive, durable enough to withstand deformation and/or deterioration resulting from repeated slamming, and strong enough to maintain its shape sufficient to protect a child's fingers when positioned between the door jamb and door when the door is closed using excessive force yet soft and/or flexible enough so as to avoid damaging the door and door jamb. Examples of suitable materials include, but are not limited to, polyethelene, polyurethane, latex, polychloroprene, silicone, EPDM rubber (ethylene propylene diene monomer), nitrile, and urethane. Suitable such materials are those having a density of between 1 pound and 3 pound or Durometer hardness of between 15 and 60. Preferably, such materials have a density of between 1.5 pounds and 2.5 pounds or Durometer hardness of between 25 and 45.

An attachment mechanism 118 is integrated into the first end 109 of the body 110. The attachment mechanism 118 can be any mechanism for hanging the guard 100 from a door knob in a manner that allows the body 110 of the guard 100 to hang freely and centered below the door knob stem (see FIG. 4 and FIG. 5). When the attachment mechanism 118 is used to hang the padded body from the door knob of the household door, the second end 109 of the padded body remains on the same side of the household door as the door knob. To hang freely and centered below the door knob stem, the presently disclosed guard lacks an attachment mechanism at second end 108. In this way, the second end of the padded body lacks a mechanism for attaching the second end of the padded body to a door knob on the opposite side of the household door. Preferably, attachment mechanism 118 is non-abrasive to avoid marring or damage to the door knob. The attachment mechanism 118 can be, for example, non-abrasive bands, hooks, and/or loops. In the example shown in FIG. 1A, the attachment mechanism 118 is a band, rope, or cord 130, wherein a portion of the band, rope, or cord 130 is sewn and/or adhered into the first end 108 of the padded body. In some embodiments, at least a portion of the attachment mechanism is sewn into and/or adhered onto first end 108 of the fabric of the gathered portion 114 of the body 110. A remaining portion of the band, rope, or cord 130 is exposed outside the body 110 and available for hanging on a door knob. The band, rope, or cord 130 can be, for example, a 2 inch to 3 inch diameter band or loop, such as an elastic band, a loop of rope (e.g., nylon rope), a loop of cord (e.g., paracord), and the like. In the example shown in FIG. 1B, at least a portion of the attachment mechanism 118 is cast into first end 108 of the padded body 110, and at least a portion of the attachment mechanism 118 projects radially outwardly from an edge of the padded body 110 at the first end 108. As such, the attachment mechanism 118 allows the padded body 110 to hang freely and centered below a stem of the door knob when the at least the portion of the attachment mechanism is placed around the stem of the door knob.

Referring now to FIG. 2 and FIG. 3 is another example of the presently disclosed guard 100, wherein the attachment mechanism 118 is a grommet 132 and the band, rope, or cord 130 (e.g., elastic band, nylon rope, paracord). Namely, the grommet 132 is integrated into the first end 108 of the padded body 110. In some embodiments, the grommet 132 is integrated into the fabric of the gathered portion 114 of the body 110. The band, rope, or cord 130 is then looped through the grommet 132 as shown in FIG. 2. FIG. 3 shows the band, rope, or cord 130 separate from the body 110 of the guard 100. In another example, the band, rope, or cord 130 is a loop of rope or cord that is tied to the grommet 132. In yet another example, the band, rope, or cord 130 is a separate 2-3 inch loop of rope or cord that can slide through the grommet 132, but has a knot that is larger in size than the opening in the grommet 132.

Referring now to FIG. 4 is a perspective view of the presently disclosed guard 100 installed on the exterior door knob of a door. For example, FIG. 4 shows a door 210 that is installed in a door frame 220 via a set of hinges 230. Further, the door 210 has a latch edge 212 and a hinge edge 214, wherein the hinge edge 214 of the door 210 is oriented toward the hinges 230. If we say that the door 210 opens "in," the door 210 has an interior door knob 216 and an exterior door knob 218. Additionally, the vertical portion of the door frame 220 is called the door jamb 222. In this example, the guard 100 is hung on the exterior door knob 218. The guard 100 is shown hanging in a resting vertical position.

When the door 210 is opened or closed slowly with low force, the guard 100 remains substantially in the resting vertical position while the door 210 swings open or closed. However and referring now to FIG. 5, when the door 210 is opened or closed rapidly or with excessive force (e.g., when the door 210 is slammed shut), the guard 100 swings from the vertical position towards a horizontal position due to centrifugal force. That is, due to centrifugal force, the lower end of the guard 100 swings outward beyond the boundary of the latch edge 212 of the door 210. "Centrifugal force" is an outward force apparent in a rotating reference frame. In this case, all indications of position and velocity are made relative to the hinges 230.

Still referring to FIG. 5, by the time the latch edge 212 of the door 210 reaches the door jamb 222 of the door frame 220, the guard 100 forms an obstruction between the door 210 and the door jamb 222. In so doing, the guard 100 prevents the door 210 from slamming shut. The pad 112 of the guard 100 absorbs the energy in the swinging door 210. Once the door 210 is at rest, there is no longer any centrifugal force present and the guard 100 returns back to the resting vertical position (due to gravity), which then allows the door 210 to be closed shut using gentle force instead of slamming force.

Referring now to FIG. 6 is a flow diagram of an example of a method 300 of operation of the presently disclosed guard 100. Namely, the method 300 is a method of preventing household doors from slamming shut when excessive force is used while closing. By way of example, FIG. 4 and FIG. 5 are referenced throughout the steps of the method 300. The method 300 may include, but is not limited to, the following steps.

At a step 310, the guard 100 is provided and then hung on the exterior door knob 218 of the door 210. At this step, the guard 100 is in the resting vertical position (see FIG. 4).

At a step 315, the door 210 is opened (see FIG. 4).

At a step 320, the door 210 is closed (see FIG. 5).

At a decision step 325, the door 210 is being closed with either low closing force or high closing force. If low closing force, then the method 300 proceeds to a step 330. However, if high closing force, then the method 300 proceeds to a step 335.

At a step 330, because there is little to no centrifugal force present, the door 210 swings closed with the guard 100 hanging substantially in the resting vertical position and causing no obstruction. The method 300 ends.

At a step 335, centrifugal force develops at the latch edge 212 of the door 210 due to high closing velocity with respect to the hinges 230.

At a step 340, as the door 210 swings closed, the lower end of the guard 100 swings in the direction that is away from the hinges 230 due to the centrifugal force (see FIG. 5). Eventually, the lower end of the guard 100 swings outward beyond the periphery of the latch edge 212 of the door 210 (see FIG. 5).

At a step 345, the lower end of the guard 100 becomes an obstruction between the latch edge 212 of the door 210 and the door jamb 222 of the door frame 220 and the closing motion stops without the door 210 slamming shut (see FIG. 5).

At a step 350, once the door 210 is at rest, there is no longer any centrifugal force present and the guard 100 returns back to the resting vertical position (due to gravity), which then allows the door 210 to be fully closed using gentle force instead of slamming force. The method 300 ends.

Accordingly, the presently disclosed subject matter provides a method of preventing a household door from slamming shut when excessive force is used to close the household door, comprising: providing a guard for preventing a household door from slamming shut when excessive force is used to close the household door, the guard comprising: a padded body comprising a first end for positioning in proximity to a door knob of a household door and a second end opposite the first end for positioning away from the door knob; and an attachment mechanism integrated into the first end of the padded body for hanging the padded body from the door knob of the household door in a manner that allows the padded body to swing freely with respect to the door knob; and instructing a purchaser of the guard to hang the guard on an exterior door knob of a household door of the purchaser; wherein when the padded body is hung from the door knob of the household door of the purchaser via the attachment mechanism and excessive force is used to close the household door, centrifugal force causes the padded body to swing between the edge of the household door and door jamb to prevent the household door from slamming shut, thereby preventing the household door from slamming shut when excessive force is used to close the household door. In some embodiments, the method includes providing a visual or audible indication that the door is being slammed shut when excessive force is used to close the door. In some embodiments, the method includes playing a pre-recorded message that provides a warning to stop slamming the door when excessive force is used to close the door. In some embodiments, the method includes providing a security mechanism on the attachment mechanism to prevent a child from easily removing the guard from the door knob.

Generally, the guard 100 is designed with dimensions that allow the padded body to swing freely when centered below and hung from a stem of a door knob of a household door, to prevent injury to a child's fingers when caught between the door and door jamb of a door that is closed with excessive force, and to allow the door to close without impediment when the door is closed using a normal gentle closing force. In some embodiments, the padded body has a minimum thickness dimension of ¼ inch, a minimum width dimension of 1 inch, and a minimum length dimension of 7 inches. In some embodiments, the padded body has as a maximum thickness dimension of 6 inches, a maximum width dimension of 3.75 inches, and a maximum length dimension of 14 inches.

Referring now to FIG. 7 is an example of the dimensions of the presently disclosed guard 100 that includes the band, rope, or cord 130 sewn into the fabric. The body 110 of the guard 100 has a length L, a width W, and a thickness T. The length L of the body 110 can be from about 7 inches to about 14 inches in one example, or is about 10 inches in another example. The width W of the body 110 can be from about 1 inch to about 3.75 inches in one example, or is about 3.25 inches in another example. The thickness T of the body 110 (including the pad 112) can be from about 0.25 inches to about 6 inches in one example, or is about 0.75 inches in another example.

The gathered portion 114 of the body 110 has a height h and a thickness t. The height h of the gathered portion 114 can be from about 0.75 inches to about 1.25 inches in one example, or is about 1 inch in another example. The thickness t of the gathered portion 114 should not exceed about 1 inch. Again, the band, rope, or cord 130 can be, for example, a 2 inch to 3 inch diameter band or loop.

The length, width, and thickness of the pad 112 are set according to the dimensions of the body 110. In the example in which the body 110 has a length L of about 10 inches, a width W of about 3.25 inches, and a thickness T of about 0.75 inches, the pad 112 can be about 9 inches long, about 3.25 inches wide, and about 0.75 inches thick. Additionally, FIG. 8 shows the grommet 132 in the gathered portion 114 of the body 110. In one example, the grommet 132 has a diameter of about 0.5 inches. Further, the weight of the guard 100 can be, for example, from about 0.7 ounces to about 2.0 ounces. In particular embodiments, the weight of the guard 100 is at least about 0.2 ounces and is based on minimum design specifications (e.g., length of 7 inches, a width of 1 inch, and a thickness of 0.25 inch). In particular embodiments, the maximum weight of the guard is approximately 13 ounces.

FIG. 9, FIG. 10, and FIG. 11 show other examples of attachment mechanisms 118 of the guard 100. Referring now to FIG. 9, the attachment mechanism 118 includes two grommets 132 and a band, rope, or cord 134 stretched between the two grommets 132. In some embodiments, the attachment mechanism can include a security mechanism to prevent a child from easily removing the guard from the door knob. For example, clasps, hasps, or threaded connections may be incorporated into the non-abrasive bands, hooks, or loops, to prevent children from easily removing the guard 100 from the door knob. For example, in FIG. 10, the attachment mechanism 118 includes a band, rope, or cord 136 in which a portion is sewn into or otherwise secured within the gathered portion 114 of the body 110 and wherein the band, rope, or cord 136 further includes a security mechanism comprising a threaded clasp 138. Referring now to FIG. 11, the attachment mechanism 118 includes a hook 140, such as a plastic or metal hook. Generally, in the guard 100, glues, cement, or other bonding agents may be used to secure nonabrasive hooks, loops, or bands into the gathered portion 114 of the body 110. Further, in the case in which the body 110 of the guard 100 is molded polymer, the molded polymer can be cast around nonabrasive hooks, loops, or bands, to secure them in place.

Referring now to FIG. 12 is more details of the presently disclosed guard 100 in relation to a door knob (e.g., the exterior door knob 218 of the door 210 of FIG. 4) on which it is hung. There is a space S between the top edge of the body 110 of the guard 100 and a shaft or stem 219 of the exterior door knob 218. The space S can be from about 0.25 inches to about 1 inch in one example, or is about 0.75 inches in another example.

Referring now to FIG. 13 is yet another example of the presently disclosed guard 100, wherein the body 110 has a pattern or design 150 and includes a pocket 152. The pattern or design 150 can be any decorative pattern or design that includes, for example, letters, words, figures, or images, of any colors. In this way, the guard 100 can be used as a decoration for door knob and door. The pocket 152 can be used to hold small items (e.g., written messages) that are left for inhabitants.

Referring now to FIG. 14A and FIG. 14B is photos of an example of the presently disclosed guard 100, wherein the attachment mechanism 118 is the grommet 132 and the band, rope, or cord 130. FIG. 15 and FIG. 16 show a front view photo and a side view photo, respectively, of the guard 100 shown in FIG. 14A and FIG. 14B when hung on a door knob.

Referring now to FIG. 17 is yet another example of the presently disclosed guard 100, wherein the body 110 has a phosphorescent image 160 incorporated thereon. In this example, the phosphorescent image 160 is a "happy face." Any number and any types of phosphorescent images 160 (e.g., characters, words, and/or images) may be provided on the guard 100. The phosphorescent images can be formed of any phosphorescent materials, such as, but not limited to, phosphorescent dye, phosphorescent paint, phosphorescent powder, and the like.

Referring now to FIG. 18 is still another example of the presently disclosed guard 100, wherein certain electronic components are built into the guard 100. The electronic components can include, for example, sensing devices, visual indicators, audible indicators, control devices, communications devices, and the like.

In one example, certain electronic components 400 are integrated into the guard 100. The electronic components 400 can include, for example, a motion sensor 410, a pressure sensor 412, a sound module 414, an LED module 416 that is used to control one or more LEDs 418, a controller 420 (e.g., any standard controller or microprocessor device), a certain amount of data storage 422 (e.g., any memory device), and a communications interface 424. Optionally, the data storage 422 and/or the communications interface 424 can be built into the controller 420. Further, the electronic components 400 includes a power source (not shown), such as a battery, for supplying power to any components thereof.

The components of the electronics 400 (e.g., the motion sensor 410, the pressure sensor 412, the sound module 414, the LED module 416, the LEDs 418, the controller 420, the data storage 422, and the communications interface 424) can be embedded in the pad 112 of the guard 100. The thickness of the pad 112 may vary in order to house and protect the components of the electronics 400.

The guard 100 may include any combinations of one, some, or all of the aforementioned components of the electronics 400. In one example, the guard 100 includes only the LED module 416 in combination with the motion sensor 410. In this example, the motion sensor 410 senses rapid motion of the guard 100 and then triggers the LED module 416, which then causes the one or more LEDs 418 to blink rapidly. Indicating excessive force being used. This is one example, of a "door slam event."

In another example, the guard 100 includes only the LED module 416 in combination with the pressure sensor 412. In this example, the pressure sensor 412 senses the impact of the guard 100 between the door and jamb and then triggers the LED module 416, which then causes the one or more LEDs 418 to blink rapidly. Again, indicating excessive force being used. This is another example, of a "door slam event."

In yet another example, the guard 100 includes only the pressure sensor 412 in combination with the sound module 414. In this example, the pressure sensor 412 senses the impact of the guard 100 between the door and jamb and then triggers the sound module 414, which activates a pre-recorded message, such as "Please stop slamming the door," or activates any audible indicators, such as a series of beeps. Again, indicating excessive force being used. This is yet another example, of a "door slam event."

In yet another example, the guard 100 includes only the motion sensor 410 in combination with the sound module 414. In this example, the motion sensor 410 senses rapid motion of the guard 100 and then triggers the sound module 414, which activates the pre-recorded message, such as "Please stop slamming the door," or activates any audible indicators, such as a series of beeps. Again, indicating excessive force being used. This is still another example, of a "door slam event."

In still another example, the guard 100 includes either or both the motion sensor 410 and the pressure sensor 412 to trigger both the LED module 416 (and LEDs 418) and the sound module 414.

Additionally, in any or all of the aforementioned examples, the controller 420 and the data storage 422 may be used to enhance any such features. For example, the controller 420 can be used to program different recorded messages or sounds, such as beeps, or to program different LED light sequences. Further, the controller 420 can be used to store "door slam events" in the data storage 422.

The communications interface 424 may be any wired and/or wireless communication interface for connecting to a network (not shown) and by which information may be exchanged with other devices connected to the network. Examples of wired communication interfaces may include, but are not limited to, USB ports, RS232 connectors, RJ45 connectors, Ethernet, and any combinations thereof. Examples of wireless communication interfaces may include, but are not limited to, an Intranet connection, Internet, ISM, Bluetooth® technology, Bluetooth® Low Energy (BLE) technology, Wi-Fi, Wi-Max, IEEE 402.11 technology, ZigBee technology, Z-Wave technology, 6LoWPAN technology (i.e., IPv6 over Low Power Wireless Area Network (6LoWPAN)), ANT or ANT+ (Advanced Network Tools) technology, radio frequency (RF), Infrared Data Association (IrDA) compatible protocols, Local Area Networks (LAN), Wide Area Networks (WAN), Shared Wireless Access Protocol (SWAP), any combinations thereof, and other types of wireless networking protocols. An example of information facilitated by the communications interface 424 includes the transmission of "door slam events" that are logged in the data storage 422 by the controller 420.

Referring again to FIG. 1 through FIG. 18, the shape of the guard 100 is not limited to rectangular. The guard 100 can be any shape, such as, but not limited to, cartoon images, collegiate mascots, insignias, words, letters, emblems, cylinders, hearts, happy faces, semi-circle, circles, and trapezoid shapes. It should be appreciated that guard 100 can be formed into any of the above shapes by forming the pad 112 or body 110. Further, the use of injection molds with polymers can be used to create the same shapes or more intricate shapes and designs. Further, symmetrical designs allow the guard 100 to be placed on the door knob facing in either direction.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A guard for preventing a household door from slamming shut when excessive force is used to close the household door, comprising:

a padded body comprising a first end for positioning in proximity to a door knob of the household door and a second end opposite the first end for positioning away from the door knob, wherein the padded body comprises an exterior body housing an interior pad, wherein the interior pad extends substantially an entire length between the first end and the second end and comprises a substantially uniform thickness along its entire length, wherein the thickness extends from a front surface of the interior pad facing away from the household door to an opposing back surface of the interior pad facing the household door; and an attachment mechanism integrated into the first end of the padded body for hanging the padded body from the door knob of the household door in a manner that allows the padded body to swing freely with respect to the door knob;

wherein when the padded body is hung from the door knob of the household door via the attachment mechanism and excessive force is used to close the household door, centrifugal force causes the padded body to swing between the edge of the household door and door jamb to prevent the household door from slamming shut.

2. The guard of claim 1, wherein the padded body has a minimum thickness dimension of ¼ inch, a minimum width dimension of 1 inch, and a minimum length dimension of 7 inches, and wherein the padded body has a maximum thickness dimension of 6 inches, a maximum width dimension of 3.75 inches, and a maximum length dimension of 14 inches.

3. The guard of claim 1, wherein the exterior body comprises a fabric covering the interior pad.

4. The guard of claim 3, wherein the fabric comprises a gathered portion proximal the first end.

5. The guard of claim 4, wherein the gathered portion is stitched or sewn closed.

6. The guard of claim 3, wherein the fabric comprises a pocket, a design, or a phosphorescent image, and combinations thereof.

7. The guard of claim 1, wherein the attachment mechanism is non-abrasive.

8. The guard of claim 1, wherein the attachment mechanism is selected from the group consisting of a band, a hook, and a loop, a rope, or cord.

9. The guard of claim 1, wherein at least a portion of the attachment mechanism is sewn into and/or adhered onto the first end of the padded body.

10. The guard of claim 1, wherein at least a portion of the attachment mechanism projects radially outwardly from an edge of the padded body at the first end.

11. The guard of claim 1, wherein the attachment mechanism allows the padded body to hang freely and centered below a stem of the door knob when the at least the portion of the attachment mechanism is placed around the stem of the door knob.

12. The guard of claim 1, wherein the attachment mechanism comprises a combination of a grommet and at least one of a band, a rope, or a cord.

13. The guard of claim 12, wherein the grommet is integrated into the first end of the padded body and at least one of the band, the rope, or the cord is looped through the grommet.

14. The guard of claim 1, wherein the attachment mechanism further comprises a security mechanism to prevent a child from easily removing the guard from the door knob.

15. The guard of claim 14, wherein the security mechanism is selected from the group consisting of a clasp, hasp, and a threaded connection.

16. The guard of claim 15, wherein the security mechanism comprises a threaded clasp.

17. The guard of claim 1, wherein the attachment mechanism comprises a combination of two grommets and at least one of a band, a rope, or a cord that is stretched between the two grommets.

18. The guard of claim 1, further comprising an electronic component integrated into the padded body.

19. The guard of claim 18, further comprising a power source to supply power the electronic component.

20. The guard of claim 18, wherein the electronic component is selected from the group consisting of a sensing device, a visual indicator, an audible indicator, a control device, a communications device, motion sensor, a pressure sensor, a sound module, an LED module, and combinations thereof.

21. A method of preventing a household door from slamming shut when excessive force is used to close the household door, comprising:

providing a guard for preventing the household door from slamming shut when excessive force is used to close the household door, the guard comprising:

a padded body comprising a first end for positioning in proximity to a door knob of the household door and a second end opposite the first end for positioning away from the door knob, wherein the padded body comprises an exterior body housing an interior pad, wherein the interior pad extends substantially an entire length between the first end and the second end and comprises a substantially uniform thickness along its entire length, wherein the thickness extends from a front surface of the interior pad facing away from the household door to an opposing back surface of the interior pad facing the household door; and an attachment mechanism integrated into the first end of the padded body for hanging the padded body from the door knob of the household door in a manner that allows the padded body to swing freely with respect to the door knob; and instructing a purchaser of the guard to hang the guard on an exterior door knob of a household door of the purchaser;

wherein when the padded body is hung from the door knob of the household door of the purchaser via the attachment mechanism and excessive force is used to close the household door, centrifugal force causes the padded body to swing between the edge of the household door and door jamb to prevent the household door from slamming shut, thereby preventing the household door from slamming shut when excessive force is used to close the household door.

22. The method of claim 21, further comprising an electronic component providing a visual or audible indication that the door is being slammed shut when excessive force is used to close the door.

23. The method of claim 21, further comprising an electronic component playing a pre-recorded message that provides a warning to stop slamming the door when excessive force is used to close the door.

24. The method of claim 21, further comprising providing a security mechanism on the attachment mechanism to prevent a child from easily removing the guard from the door knob.

* * * * *